US010145240B2

(12) United States Patent
Ludwig

(10) Patent No.: US 10,145,240 B2
(45) Date of Patent: Dec. 4, 2018

(54) DOWNHOLE FORMATION FLUID SAMPLER HAVING AN INERT SAMPLING BAG

(71) Applicant: Halliburton Energy Services, Inc., Houston, TX (US)

(72) Inventor: Wesley Neil Ludwig, Fort Worth, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 267 days.

(21) Appl. No.: 14/911,383

(22) PCT Filed: Oct. 30, 2013

(86) PCT No.: PCT/US2013/067573
§ 371 (c)(1),
(2) Date: Feb. 10, 2016

(87) PCT Pub. No.: WO2015/065391
PCT Pub. Date: May 7, 2015

(65) Prior Publication Data

US 2016/0186561 A1 Jun. 30, 2016

(51) Int. Cl.
*E21B 49/08* (2006.01)

(52) U.S. Cl.
CPC ..... *E21B 49/081* (2013.01); *E21B 49/082* (2013.01)

(58) Field of Classification Search
CPC ..... E21B 49/081; E21B 49/082
See application file for complete search history.

(56) References Cited

U.S. PATENT DOCUMENTS

| | | | | |
|---|---|---|---|---|
| 5,585,726 | A | 12/1996 | Chau | |
| 6,084,052 | A | 7/2000 | Aufdermarsh et al. | |
| 6,148,914 | A | 11/2000 | Guieze et al. | |
| 6,216,782 | B1 * | 4/2001 | Skinner | E21B 49/081 166/250.01 |
| 7,083,009 | B2 | 8/2006 | Paluch et al. | |
| 2003/0024738 | A1 | 2/2003 | Schuh | |
| 2010/0185395 | A1 | 7/2010 | Pirovolou et al. | |
| 2010/0319912 | A1 | 12/2010 | Pop et al. | |
| 2011/0067860 | A1 | 3/2011 | Corre et al. | |
| 2012/0024606 | A1 | 2/2012 | Pirovolou et al. | |
| 2012/0285701 | A1 | 11/2012 | Cheng et al. | |

(Continued)

OTHER PUBLICATIONS

International Search Report and the Written Opinion of the International Searching Authority, or the Declaration, dated Jul. 21, 2014, PCT/US2013/067573, 12 pages, ISA/KR.

(Continued)

*Primary Examiner* — Caroline N Butcher
(74) *Attorney, Agent, or Firm* — Haynes and Boone, LLP

(57) ABSTRACT

A downhole formation fluid sampler. The sampler includes at least one sampling chamber having an internal fluid chamber, a fluid inlet operable to receive a formation fluid and a fluid outlet. An inflatable bag is disposed within the internal fluid chamber. The inflatable bag is operably associated with the fluid inlet. A fluid cushion is disposed within the internal fluid chamber exterior of the inflatable bag such that filling the inflatable bag with the formation fluid through the fluid inlet displaces the fluid cushion from the internal fluid chamber through the fluid outlet.

18 Claims, 3 Drawing Sheets

(56) References Cited

U.S. PATENT DOCUMENTS

| | | | | |
|---|---|---|---|---|
| 2013/0167667 | A1* | 7/2013 | Mihaylov | G01N 1/00 73/864 |
| 2013/0213645 | A1 | 8/2013 | Proett et al. | |

OTHER PUBLICATIONS

Examination Report issued for GCC Patent Application No. 2014-27892, dated Aug. 16, 2017.

International Search Report and the Written Opinion of the International Searching Authority, or the Declaration, dated Mar. 7, 2014, PCT/US2013/064572, 10 pages, ISA/US.

* cited by examiner

DOWNHOLE FORMATION FLUID SAMPLER HAVING AN INERT SAMPLING BAG

The present application is a U.S. National Stage patent application of International Patent Application No. PCT/US2013/067573, filed on Oct. 30, 2013, the benefit of which is claimed and the disclosure of which is incorporated herein by reference in its entirety.

TECHNICAL FIELD OF THE DISCLOSURE

This disclosure relates, in general, to equipment utilized in conjunction with operations performed in relation to subterranean wells and, in particular, to a downhole formation fluid sampler having an inert sampling bag disposed within a sampling chamber for maintaining the integrity of a formation fluid sample.

BACKGROUND

Without limiting the scope of the present disclosure, its background is described with reference to testing hydrocarbon formations, as an example.

It is well known in the subterranean well drilling and completion art to perform tests on formations intersected by a wellbore. Such tests are typically performed in order to determine geological or other physical properties of the formation and fluids contained therein. For example, parameters such as permeability, porosity, fluid resistivity, temperature, pressure, fluid composition and saturation pressure may be determined. These and other characteristics of the formation and fluid contained therein may be determined by performing tests on the formation before the well is completed.

One type of testing procedure that is commonly performed is to obtain fluid samples from the formation to, among other things, determine the composition of the formation fluids. In this procedure, it is important to obtain samples of the formation fluid that are representative of the fluids as they exist in the formation. In a typical sampling procedure, samples of the formation fluids may be obtained by lowering a downhole formation fluid sampler having one or more sampling chambers into the wellbore on a conveyance such as a wireline, slickline, coiled tubing, jointed tubing or the like. When the downhole formation fluid sampler reaches the desired depth, ports are opened to allow collection of one or more formation fluid samples. The ports may be actuated in variety of ways such as by electrical, hydraulic or mechanical methods. Once the ports are opened, formation fluids travel through the ports and the samples of the formation fluids are collected within the sampling chambers. After the samples have been collected, the downhole formation fluid sampler may be withdrawn from the wellbore so that the formation fluid samples may be analyzed.

BRIEF DESCRIPTION OF THE DRAWINGS

For a more complete understanding of the features and advantages of the present disclosure, reference is now made to the detailed description along with the accompanying figures in which corresponding numerals in the different figures refer to corresponding parts and in which.

DETAILED DESCRIPTION

Figure 1A:
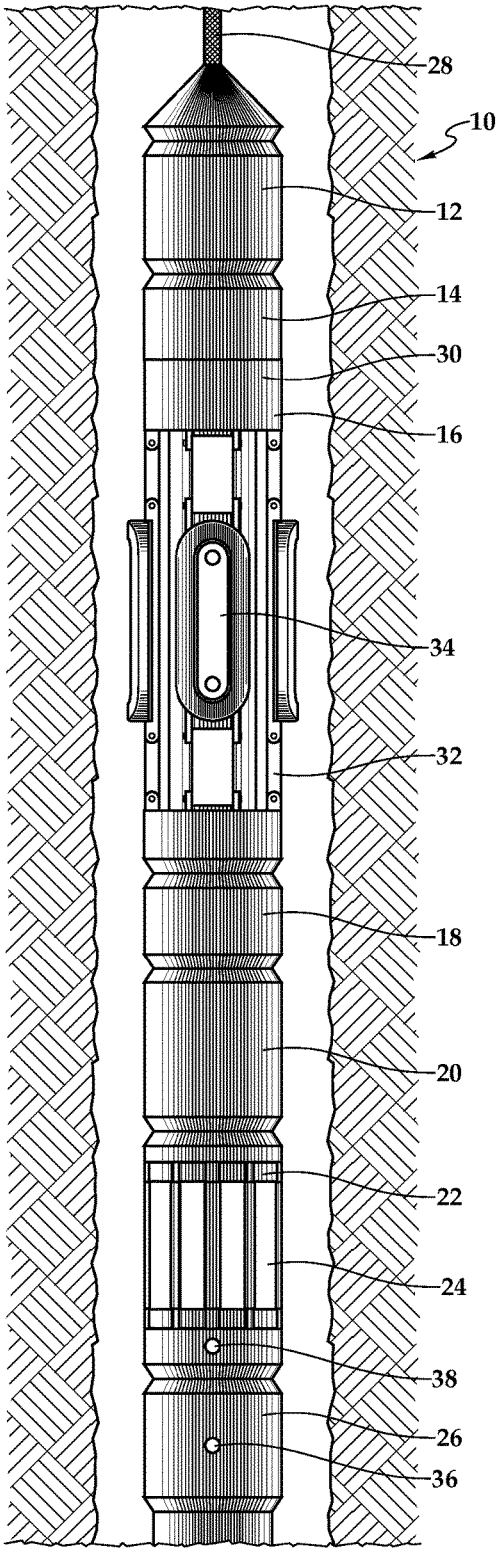
FIGS. 1A-1B are schematic illustrations of a well system including a downhole formation fluid sampler according to an embodiment of the present disclosure in its running configuration and its deployed configuration, respectively.

While various system, method and other embodiments are discussed in detail below, it should be appreciated that the present disclosure provides many applicable inventive concepts, which can be embodied in a wide variety of specific contexts. The specific embodiments discussed herein are merely illustrative, and do not delimit the scope of the present disclosure.

In a first aspect, the present disclosure is directed to a downhole formation fluid sampler. The sampler includes at least one sampling chamber having an internal fluid chamber, a fluid inlet operable to receive a formation fluid and a fluid outlet. An inflatable bag is disposed within the internal fluid chamber. The inflatable bag is operably associated with the fluid inlet. A fluid cushion is disposed within the internal fluid chamber exterior of the inflatable bag such that filling the inflatable bag with the formation fluid through the fluid inlet displaces the fluid cushion from the internal fluid chamber through the fluid outlet.

In one embodiment, the inflatable bag may be formed from a material inert to the formation fluid such as polymers, elastomers, thermoplastics, polyaryletherketones, fluoroelastomers, polytetrafluoroethylenes or similar material. In some embodiments, the sampler may include a fluid flow control device operable to allow and prevent entry of the formation fluid into the inflatable bag and a fluid flow control device operable to allow and prevent discharge of the fluid cushion from the internal fluid chamber. In certain embodiments, the sampler may include spacer members having arcuate surfaces disposed between the inflatable bag and ends of the internal fluid chamber. In various embodiments, the sampler may include a flow restrictor operable to regulate a discharge rate of the fluid cushion as the inflatable bag is inflated with the formation fluid. In particular embodiments, the sampler may include a piston chamber operably associated with the fluid outlet having a floating piston disposed therein. The piston may be shifted in a first direction responsive to the discharge of the fluid cushion through the fluid outlet and shifted in a second direction responsive to a charging fluid acting on the piston such that movement of the piston in the second direction pressurizes the formation fluid in the inflatable bag responsive to the cushion fluid reentering the internal fluid chamber.

In a second aspect, the present disclosure is directed to a downhole formation fluid sampler. The sampler includes at least one sampling chamber having an internal fluid chamber, a fluid inlet operable to receive a formation fluid and a fluid outlet. An inflatable bag is disposed within the internal fluid chamber. The inflatable bag is operably associated with the fluid inlet. A fluid cushion is disposed within the internal fluid chamber exterior of the inflatable bag. A fluid flow control device is in fluid communication with the fluid inlet and is operable to allow and prevent entry of the formation fluid into the inflatable bag. A flow restrictor is in fluid communication with the fluid outlet. A fluid flow control device is in fluid communication with the fluid outlet and is operable to allow and prevent discharge of the fluid cushion from the internal fluid chamber, such that filling the inflatable bag with the formation fluid through the fluid inlet displaces the fluid cushion from the internal fluid chamber through the fluid outlet and such that the flow restrictor regulates a discharge rate of the fluid cushion as the inflatable bag is inflated with the formation fluid.

In a third aspect, the present disclosure is directed to a method of sampling formation fluid. The method includes running a downhole formation fluid sampler into a wellbore, the sampler including at least one sampling chamber having an internal fluid chamber, a fluid inlet and a fluid outlet; filling an inflatable bag disposed within the internal fluid chamber with formation fluid through the fluid inlet; and displacing a fluid cushion disposed within the internal fluid chamber exterior of the inflatable bag from the internal fluid chamber through the fluid outlet. The method may also include regulating a discharge rate of the fluid cushion with a flow restrictor in fluid communication with the fluid outlet.

Figure 1B:
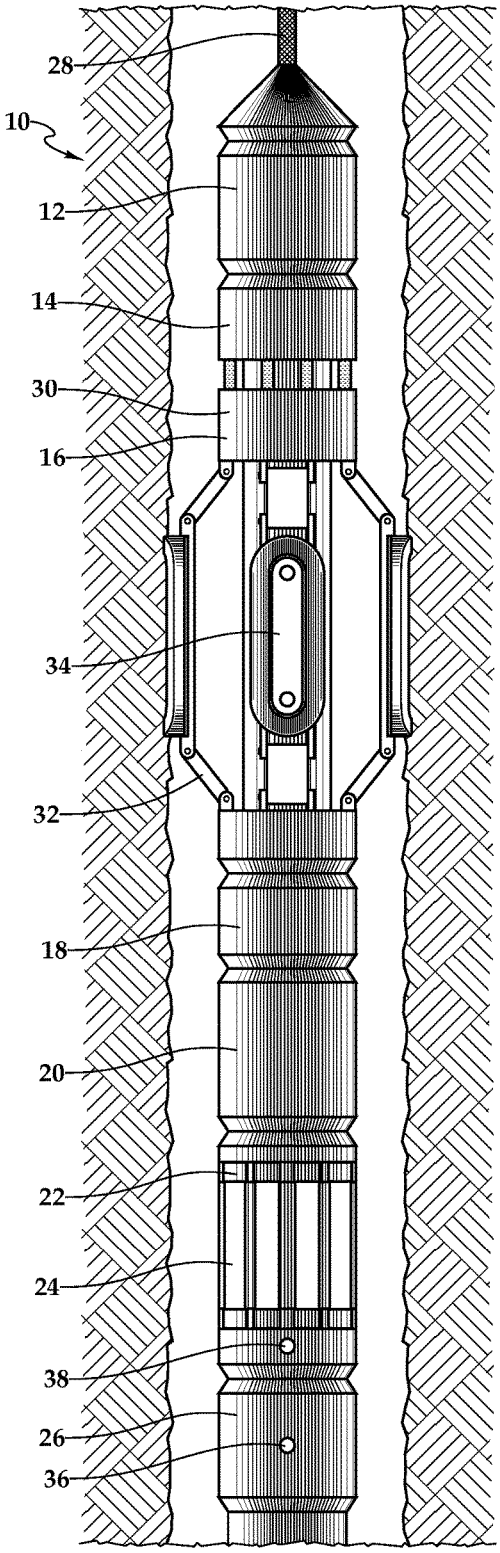

Referring initially to FIGS. 1 and 2, therein are depicted schematic illustrations of a well system including a downhole formation fluid sampler tool in its radially contracted running configuration and its radially expanded deployed configuration, respectively, that is generally designated 10. Downhole formation fluid sampler tool 10 includes a plurality of modules or sections capable of performing various functions. In the illustrated embodiment, tool 10 include a power telemetry module 12 that provides electrical and data communication between the modules of tool 10 and a remote control unit (not pictured) that may be located uphole or at the surface, an actuation module 14 that converts electrical power into hydraulic power, a probe module 16 that takes samples of the formation fluids, a fluid test module 18 that performs various tests on fluid samples, a flow control module 20 that regulates the flow of fluids in and out of tool 10, a multi-chamber sample collection module 22 that includes a plurality of sampling chambers 24 for receiving and storage of the collected fluid samples and possibly other sections designated collectively as module 26. Even though a particular arrangement of the various modules has been described and depicted in FIG. 1, those skilled in the art will understand that other arrangements of modules including both a greater number and a lesser number of modules is possible and is considered to be within the scope of the present disclosure.

More specifically, power telemetry section 12 conditions power for the remaining tool sections. Each section preferably has its own process-control system and can function independently. While section 12 provides a common intra-tool power bus, the entire tool string shares a common communication bus that is compatible with other logging tools. In the illustrated embodiment, tool 10 is conveyed in the borehole by wireline 28, which contains conductors for carrying power to the various components of tool 10 and conductors or cables such as coaxial or fiber optic cables for providing two-way data communication between tool 10 and the remote control unit. The control unit preferably comprises a computer and associated memory for storing programs and data. The control unit generally controls the operation of tool 10 and processes data received from it during operations. The control unit may have a variety of associated peripherals, such as a recorder for recording data, a display for displaying desired information, printers and the like. The use of the control unit, display and recorder are known in the art of well logging and are, thus, not discussed further. In a specific embodiment, telemetry module 12 may provide both electrical and data communication between the modules and the control unit. In particular, telemetry module 12 provides a high-speed data bus from the control unit to the modules to download sensor readings and upload control instructions initiating or ending various test cycles and adjusting different parameters, such as the rates at which various pumps are operating. Even though tool 10 has been depicted as being wireline conveyed, it should be understood by those skilled in the art that sampler tools could alternatively be conveyed by other means including, but not limited to, slickline, coiled tubing, jointed tubing or the like. It should also be noted that tool 10 could be part of a logging while drilling (LWD) tool string wherein power for the tool systems may be generated by a downhole turbine driven by circulating mud and data may be transmitted using a mud pulse module.

Actuation module 14 is operably associated with a setting assembly 30 including a linkage assembly 32 of probe module 16. Actuation module 14 is operated to apply an axial compression force on setting assembly 30. In the illustrated embodiment, when the axial compression force is applied to linkage assembly 32 of setting assembly 30, linkage assembly 32 is operated from its radially contracted running configuration (FIG. 1) to its radially expanded deployed configuration (FIG. 2), which radially outwardly deploys probes 34 to establish a hydraulic connection between probes 34 and the formation. In the illustrated embodiment, actuation module 14 is depicted as an electro-hydraulic module including an electric motor operable to supply pressurized fluid that acts on one or more hydraulic cylinders that apply the axial compression force on setting assembly 30. Even though actuation module 14 has been described and depicted as being an electrohydraulic module, it should be understood by those skilled in the art that actuation module 14 could alternatively apply the axial compression force on setting assembly 30 by other means including, but not limited to, electromechanical means such as using a direct drive electrical motor with a screw mechanism that is operated to apply the axial compression force on setting assembly 30.

Fluid testing section 18 of tool 10 contains one or more fluid testing devices (not visible in FIG. 1), which analyze the fluid samples obtained during sampling operations. For example, one or more fluid sensors may be utilized to analyze the fluid such as quartz gauges that enable measurement of such parameters as the drawdown pressure of fluid being withdrawn and fluid temperature. In addition, if at least two fluid testing devices are run in tandem, the pressure difference between them can be used to determine fluid viscosity during pumping or fluid density when flow is stopped. Also, when flow is stopped, a pressure buildup analysis can be preformed.

Flow control module 20 of tool 10 includes a pump such as a double acting piston pump (not visible in FIG. 1), which controls the formation fluid flow into tool 10 from probes 34. The pump's operation is generally monitored by the control unit. Fluid entering probes 34 flows through one or more flow lines (not visible in FIG. 1) and may be discharged into the wellbore via outlet 36. Fluid control devices, such as control valves and/or a manifold (not visible in FIG. 1), may be connected to the flow lines for controlling the fluid flow from the flow lines into the borehole or into storage chambers 24. Flow control module 18 may further include strain-gauge pressure transducers that measure inlet and outlet pump pressures.

Sample collection module 22 of tool 10 may contain various sampling chambers 24 for receiving and storing the collected fluid samples. Chamber section 22 preferably contains at least one sampling chamber 24 having an inert sample bag (not visible in FIG. 1) disposed therein for maintaining the integrity of the formation fluid sample. A conduit may provide fluid communication between the lower side of a piston and the outside environment such as the wellbore via one or more fluid ports 38 to applying charging pressure on collected samples. A fluid flow control device, such as an electrically controlled valve, can be placed in the conduit to selectively open it to allow fluid communication between the lower side of the piston system and the wellbore. Similarly, an inlet to chamber section 24 may also contain a fluid flow control device, such as an electrically operated control valve, which is selectively opened and closed to direct the formation fluid from the flow lines into the sample bag. Preferably, one or more sensors are used to determine when the formation fluid is clean then the control valve is opened to allow a sample to be taken. As a sample is taken in the sample bag of chamber 24, a piston may be driven down or fluid from a fluid cushion may be flowed through a restrictor to maintain suitable pressure on the exterior of the sample bag during filling.

Probe module 16 includes a plurality of probes 34, three of four being visible in FIG. 1, that are uniformly circumferentially distributed around probe module 16. Probes 34 facilitate testing, sampling and retrieval of fluids from the formation. Each probe 34 includes a sealing pad that makes contact with the formation. In certain embodiments, probes 34 are provided with at least one elongated sealing pad providing sealing contact with a surface of the borehole. Through one or more slits, fluid flow channels or recesses in the sealing pad, fluids from the sealed-off part of the formation surface may be collected within tester tool 10 through one or more inlets of the sealing pad and one or more fluid flow lines within probe module 16 and tool 10. The recess or recesses in each pad may be elongated, preferably along the axis of the elongated pad and generally in the direction of the borehole axis.

Figure 2A:
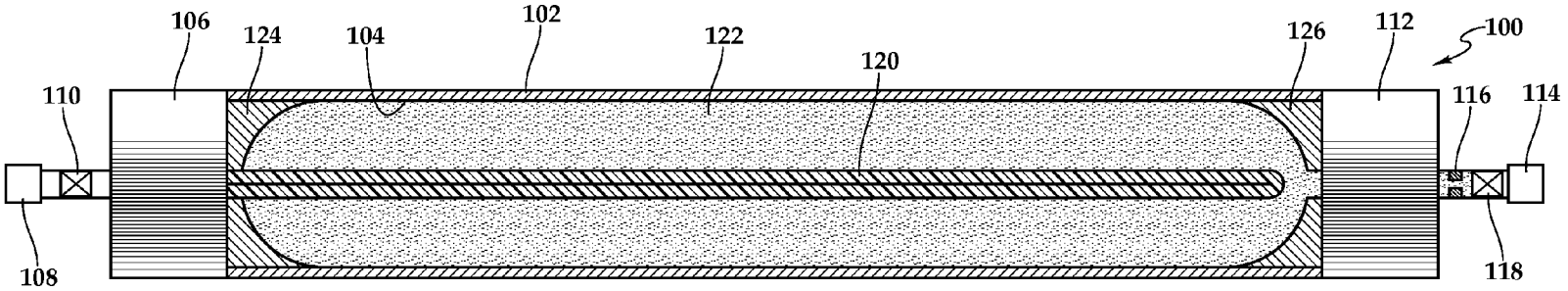
FIGS. 2A-2B are schematic illustrations of a sampling chamber for use in a downhole formation fluid sampler according to an embodiment of the present disclosure in its various operating configurations.
Figure 2B:
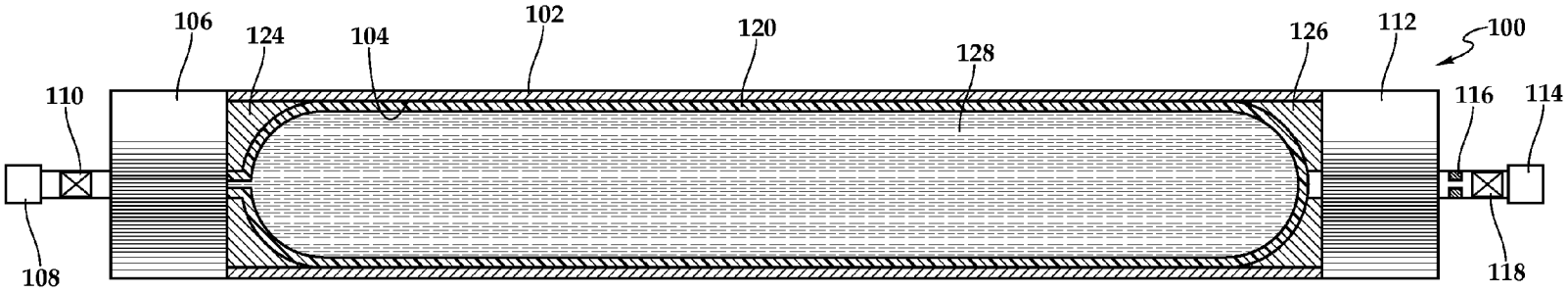

Referring next to FIGS. 2A-2B, therein are schematic illustrations of a sampling chamber for use in a downhole formation fluid sampler according to an embodiment of the present disclosure in its various operating configurations that is generally designated 100. Sampling chamber 100 has a housing 102 that is preferably formed from a metal such as steel, stainless steel, titanium, Inconel or similar material that is suitable for pressure containment. Housing 102 defines an internal fluid chamber 104. Housing 102 is securably coupled to an end cap 106 by threading or other suitable means. End cap 106 includes a fluid inlet 108. In the illustrated embodiment, a fluid flow control device 110, such as an electrically operated control valve, is disposed within a fluid flow section of fluid inlet 108. Housing 102 is securably coupled to an end cap 112 by threading or other suitable means. End cap 112 includes a fluid outlet 114. In the illustrated embodiment, a flow restrictor 116, such as an orifice, and a fluid flow control device 118, such as an electrically operated control valve, are disposed within a fluid flow section of fluid outlet 114.

An inflatable bag 120 is disposed within internal fluid chamber 104 and is securably and sealingly coupled to or otherwise operably associated with fluid inlet 108 such that formation fluid may enter and fill inflatable bag 120 through fluid inlet 108. Preferably, inflatable bag 120 is formed from a material that is inert to formation fluids such as polymers, elastomers, thermoplastics, polyaryletherketones, fluoroelastomers, polytetrafluoroethylenes or similar material. Disposed in the region exterior to inflatable bag 120 inside of internal fluid chamber 104 is a fluid cushion 122 that is preferably a substantially incompressible fluid such as water, hydraulic fluid or the like. In the illustrated embodiment, spacer members 124, 126 are disposed within opposite ends of internal fluid chamber 104. Spacer members 124, 126 have arcuate surfaces which prevent inflatable bag 120 from contacting the corner surfaces within internal fluid chamber 104 and creating high stress regions in inflatable bag 120 after filling. Spacer members 124, 126 are preferably formed from a material similar to that of inflatable bag 120 such as polymers, elastomers, thermoplastics, polyaryletherketones, fluoroelastomers, polytetrafluoroethylenes or similar material. Depending upon the implementation, spacer member 126 may have a single exit port, as illustrated, or may have multiple smaller exits ports to allow flow of fluid cushion 122 therethrough. As another alternative, fluid cushion 122 may be allowed to travel between the exterior of spacer member 126 and the interior of internal fluid chamber 104 which would remove the need for any openings through spacer member. Additionally, a spring or similar device may be positioned between inflatable bag 120 and spacer member 126 to prevent contact between inflatable bag 120 any openings of spacer member 126 to prevent possible extrusion inflatable bag 120, depending upon the materials selected therefor.

In operation, one or more sampling chambers 100 may be run downhole as part of downhole formation fluid sampler tool 10, described above. As best seen in FIG. 2A, in the run in configuration of sampling chamber 100, the interior of inflatable bag 120 is preferable void of any fluids and otherwise empty, fluid flow control device 110 is in the closed position, fluid cushion 122 fills the space within internal fluid chamber 104 exterior of inflatable bag 120 and fluid flow control device 118 is in the closed position. In this configuration, no fluid may enter inflatable bag 120 and none of fluid cushion 122 can exit internal fluid chamber 104. When sampler tool 10 is positioned in the desired location downhole and suitably actuated, a fluid sample may now be obtained within sampling chamber 100. This is achieved by opening fluid flow control device 110 to allow formation fluid 128 to enter inflatable bag 120 through fluid inlet 108 and by opening fluid flow control device 118 to allow fluid cushion 122 to exit internal fluid chamber 104 through fluid outlet 114, as best seen in FIG. 2B. Preferably, as formation fluid 128 fills inflatable bag 102, the rate at which fluid cushion 122 exits internal fluid chamber 104 is regulated by flow restrictor 116 such that suitable pressure is maintained on the exterior of inflatable bag 120 and therefore on formation fluid 128 entering inflatable bag 120 to prevent formation fluid 128 reaching or dropping below its saturation pressure creating the possibility of asphaltene deposition and flashing of entrained gasses or otherwise experiencing a pressure change degradation.

Preferably, inflatable bag 120 accepts formation fluid 128 until the outer surface of inflatable bag 120 come in contact with internal fluid chamber 104 and spacer members 124, 126 such that housing 102 provides support to inflatable bag 120 for pressure containment. After the fluid sample is received within inflatable bag 120, fluid flow control device 110 is closed to prevent escape of formation fluid 128. In addition, fluid flow control device 118 may be closed or may remain open depending upon the configuration of sampler tool 10. Sampler tool 10 may now be retrieved to the surface. Thereafter, sampling chamber 100 may be removed from sampler tool 10 if desired and stored with similar sampling chambers 100 until it is time for formation fluid analysis. During the retrieval and storage time period, formation fluid 128 is disposed within inflatable bag 120 and is not in contact with the metal of sampling chamber 100. Preventing fluid sample exposure to the metal of sampling chamber 100 alleviates the possibility that certain constituents of formation fluid 128, such as hydrogen sulfide or mercury, may be absorbed into the metal, prevents sample contamination by impurities previously absorbed by the metal and otherwise prevents chemical degradation due to contact with the metal. In addition, inflatable bag 120 provides protection to sampling chamber 100. For example, minimizing contact between the formation fluid and the interior of sampling chamber 100 prevents formation fluid constituent absorption and corrosion as well as any other detrimental effects. Further, use of inflatable bag 120 reduces the requirement to clean the interior of sampling chamber 100 as a new inflatable bag 120 may be used for each sampling run.

Figure 3A:
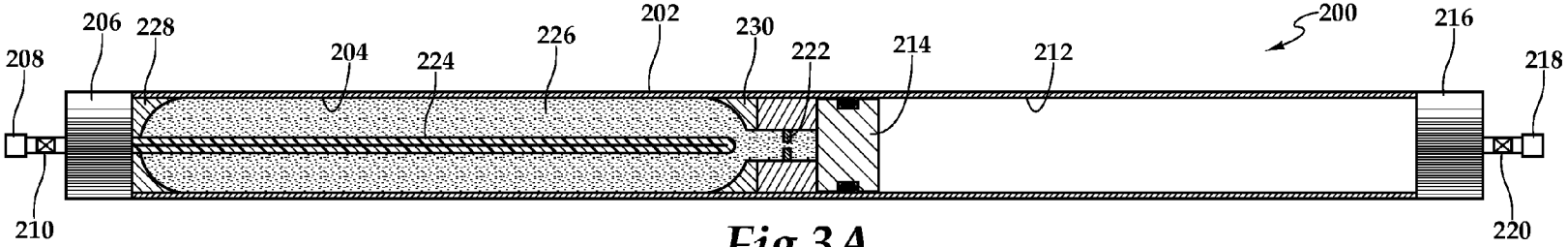
FIGS. 3A-3C are schematic illustrations of a sampling chamber for use in a downhole formation fluid sampler according to an embodiment of the present disclosure in its various operating configurations.
Figure 3B:
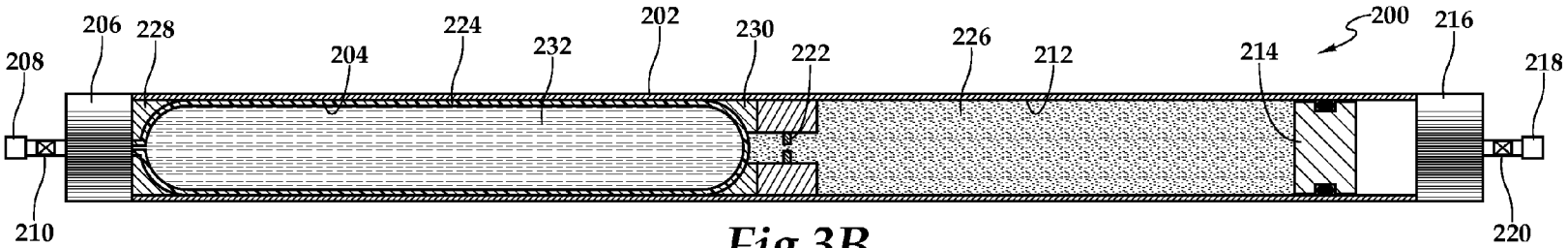
Figure 3C:
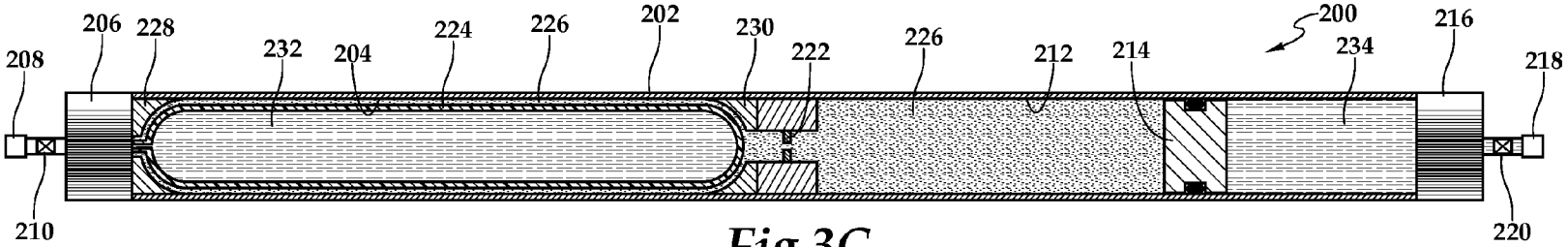

Referring next to FIGS. 3A-3C, therein are schematic illustrations of a sampling chamber for use in a downhole formation fluid sampler according to an embodiment of the present disclosure in its various operating configurations that is generally designated 200. Sampling chamber 200 has a housing 202 that is preferably formed from a metal such as steel, stainless steel, titanium, Inconel or similar material that is suitable for pressure containment. Housing 202 defines an internal fluid chamber 204. Housing 202 is securably coupled to an end cap 206 by threading or other suitable means. End cap 206 includes a fluid inlet 208. In the illustrated embodiment, a fluid flow control device 210, such as an electrically operated control valve, is disposed within a fluid flow section of fluid inlet 208. Housing 202 defines a piston chamber 212 having a floating piston 214 slidably disposed therein. In the illustrated embodiment, the lower portion of piston chamber 212 is filled with a compressible fluid such as air or nitrogen. Alternatively, the lower portion of piston chamber 212 could be filled with a substantially incompressible fluid such as water. Housing 202 is securably coupled to an end cap 216 by threading or other suitable means. End cap 216 includes a fluid outlet 218. In the illustrated embodiment, a fluid flow control device 220, such as an electrically operated control valve, is disposed within a fluid flow section of fluid outlet 218. A flow restrictor 222, such as an orifice, is positioned within housing 202 between internal fluid chamber 204 and piston chamber 212.

An inflatable bag 224 is disposed within internal fluid chamber 204 and is securably and sealingly coupled to or otherwise operably associated with fluid inlet 208 such that formation fluid may enter and fill inflatable bag 224 through fluid inlet 208. Preferably, inflatable bag 224 is formed from a material that is inert to formation fluids such as polymers, elastomers, thermoplastics, polyaryletherketones, fluoroelastomers, polytetrafluoroethylenes or similar material. Disposed in the region exterior to inflatable bag 224 inside of internal fluid chamber 204 is a fluid cushion 226 that is preferably a substantially incompressible fluid such as water, hydraulic fluid or the like. In the illustrated embodiment, spacer members 228, 230 are disposed within opposite ends of internal fluid chamber 204. Spacer members 228, 230 have arcuate surfaces which prevent inflatable bag 224 from contacting the corner surfaces within internal fluid chamber 204 and creating high stress regions in inflatable bag 224 after filling. Spacer members 228, 230 are preferably formed from a material similar to that of inflatable bag 224 such as polymers, elastomers, thermoplastics, polyaryletherketones, fluoroelastomers, polytetrafluoroethylenes or similar material.

In operation, one or more sampling chambers 200 may be run downhole as part of downhole formation fluid sampler tool 10, described above. As best seen in FIG. 3A, in the run in configuration of sampling chamber 200, the interior of inflatable bag 224 is preferable void of any fluids and otherwise empty, fluid flow control device 210 is in the closed position, fluid cushion 226 fills the space within internal fluid chamber 204 exterior of inflatable bag 224 and fluid flow control device 220 is in the closed position. In this configuration, no fluid may enter inflatable bag 224 and none of fluid cushion 226 can exit internal fluid chamber 204 as pressure within the lower portion of piston chamber 212 biases floating piston 214 in the uphole direction. When sampler tool 10 is positioned in the desired location downhole and suitably actuated, a fluid sample may now be obtained within sampling chamber 200. This is achieved by opening fluid flow control device 210 to allow formation fluid 232 to enter inflatable bag 224 through fluid inlet 208. In the case of a compressible fluid in the lower portion of piston chamber 212, fluid flow control device 220 may remain closed as best seen in FIG. 3B or may be opened. In the case of a substantially incompressible fluid in the lower portion of piston chamber 212, fluid flow control device 220 is opened.

In any case, the pressure to the interior of inflatable bag 224 causes fluid cushion 226 to exit internal fluid chamber 204 passing through flow restrictor 222. Preferably, as formation fluid 232 fills inflatable bag 224, the rate at which fluid cushion 226 exits internal fluid chamber 204 is regulated by flow restrictor 222 and/or compression of the compressible fluid in piston chamber 212 such that suitable pressure is maintained on the exterior of inflatable bag 224 and therefore on formation fluid 232 entering inflatable bag 224 to prevent formation fluid 232 reaching or dropping below its saturation pressure creating the possibility of asphaltene deposition and flashing of entrained gasses or otherwise experiencing a pressure change degradation. Preferably, inflatable bag 224 accepts formation fluid 232 until the outer surface of inflatable bag 224 come in contact with internal fluid chamber 204 and spacer members 228, 230 such that housing 202 provides support to inflatable bag 224 for pressure containment. After the fluid sample is received within inflatable bag 224, fluid flow control device 210 is closed to prevent escape of formation fluid 232. In addition, fluid flow control device 220 may be opened or may remain open depending upon the configuration of sampler tool 10. In the illustrated embodiment, formation fluid 234 or other pressurized fluid is allowed to enter the lower portion of piston chamber 212 through fluid outlet 218 to pressurize formation fluid 232 received in sample chamber 200 such that the fluid sample may be retrieved to the surface without pressure and/or temperature change degradation by maintaining the pressure of formation fluid 232 above its saturation pressure. After retrieval to the surface, sampling chamber 200 may be removed from sampler tool 10 if desired and stored with similar sampling chambers 200 until it is time for formation fluid analysis. During the retrieval and storage time period, formation fluid 232 within sampling chamber 200 is not subject to chemical degradation as it is disposed within inflatable bag 224 and not in contact with the metal of sampling chamber 200.

It should be understood by those skilled in the art that the illustrative embodiments described herein are not intended to be construed in a limiting sense. Various modifications and combinations of the illustrative embodiments as well as other embodiments will be apparent to persons skilled in the art upon reference to this disclosure. It is, therefore, intended that the appended claims encompass any such modifications or embodiments.

What is claimed is:

1. A downhole formation fluid sampler comprising:

at least one sampling chamber having an internal fluid chamber, a fluid inlet operable to receive a formation fluid and a fluid outlet;

an inflatable bag disposed within the internal fluid chamber, the inflatable bag operably associated with the fluid inlet;

spacer members having arcuate surfaces disposed between the inflatable bag and ends of the internal fluid chamber; and a fluid cushion disposed within the internal fluid chamber exterior of the inflatable bag;

wherein, filling the inflatable bag with the formation fluid through the fluid inlet displaces the fluid cushion from the internal fluid chamber through the fluid outlet.

2. The sampler as recited in claim 1 wherein the inflatable bag further comprises a material inert to the formation fluid.

3. The sampler as recited in claim 1 wherein the inflatable bag further comprises a polymer.

4. The sampler as recited in claim 1 wherein the inflatable bag further comprises an elastomer.

5. The sampler as recited in claim 1 wherein the inflatable bag further comprises a thermoplastic.

6. The sampler as recited in claim 1 wherein the inflatable bag further comprises a polyaryletherketone.

7. The sampler as recited in claim 1 wherein the inflatable bag further comprises a polytetrafluoroethylene.

8. The sampler as recited in claim 1 further comprising a fluid flow control device to operably allow and prevent entry of the formation fluid into the inflatable bag and a fluid flow control device to operably allow and prevent discharge of the fluid cushion from the internal fluid chamber.

9. The sampler as recited in claim 1 further comprising a flow restrictor operable to regulate a discharge rate of the fluid cushion as the inflatable bag is inflated with the formation fluid.

10. The sampler as recited in claim 1 further comprising a piston chamber operably associated with the fluid outlet having a floating piston disposed therein, the piston shifting in a first direction responsive to the discharge of the fluid cushion through the fluid outlet and shifting in a second direction responsive to a charging fluid acting on the piston such that movement of the piston in the second direction pressurizes the formation fluid in the inflatable bag responsive to the cushion fluid reentering the internal fluid chamber.

11. A downhole formation fluid sampler comprising:

at least one sampling chamber having an internal fluid chamber, a fluid inlet operable to receive a formation fluid and a fluid outlet;

an inflatable bag disposed within the internal fluid chamber, the inflatable bag operably associated with the fluid inlet;

spacer members having arcuate surfaces disposed between the inflatable bag and ends of the internal fluid chamber;

a fluid cushion disposed within the internal fluid chamber exterior of the inflatable bag;

a fluid flow control device in fluid communication with the fluid inlet and operable to allow and prevent entry of the formation fluid into the inflatable bag;

a flow restrictor in fluid communication with the fluid outlet; and a fluid flow control device in fluid communication with the fluid outlet and operable to allow and prevent discharge of the fluid cushion from the internal fluid chamber;

wherein, filling the inflatable bag with the formation fluid through the fluid inlet displaces the fluid cushion from the internal fluid chamber through the fluid outlet; and wherein, the flow restrictor regulates a discharge rate of the fluid cushion as the inflatable bag is inflated with the formation fluid.

12. The sampler as recited in claim 11 wherein the inflatable bag further comprises a material inert to the formation fluid.

13. The sampler as recited in claim 11 wherein the inflatable bag further comprises a material selected from the group consisting of polymers, elastomers, thermoplastics, polyaryletherketones, fluoroelastomers and polytetrafluoroethylenes.

14. The sampler as recited in claim 11 further comprising a piston chamber operably associated with the fluid outlet having a floating piston disposed therein, the piston shifting in a first direction responsive to the discharge of the fluid cushion through the fluid outlet and shifting in a second direction responsive to a charging fluid acting on the piston such that movement of the piston in the second direction pressurizes the formation fluid in the inflatable bag responsive to the cushion fluid reentering the internal fluid chamber.

15. A method of sampling formation fluid comprising:

running a downhole formation fluid sampler into a wellbore, the sampler including:

at least one sampling chamber having an internal fluid chamber;

an inflatable bag disposed within the internal fluid chamber;

spacer members having arcuate surfaces disposed between the inflatable bag and ends of the internal fluid chamber;

a fluid inlet; and a fluid outlet;

filling the inflatable bag disposed within the internal fluid chamber with formation fluid through the fluid inlet; and displacing a fluid cushion disposed within the internal fluid chamber exterior of the inflatable bag from the internal fluid chamber through the fluid outlet.

16. The method as recited in claim 15 further comprising regulating a discharge rate of the fluid cushion with a flow restrictor in fluid communication with the fluid outlet.

17. The method as recited in claim 15 wherein the inflatable bag further comprises a material inert to the formation fluid.

18. The method as recited in claim 17 wherein the inflatable bag further comprises a material selected from the group consisting of polymers, elastomers, thermoplastics, polyaryletherketones, fluoroelastomers and polytetrafluoroethylenes.

* * * * *